US009849562B2

(12) United States Patent
Sweeney et al.

(10) Patent No.: US 9,849,562 B2
(45) Date of Patent: Dec. 26, 2017

(54) AND MANUFACTURE OF AN ABRASIVE POLISHING TOOL

(71) Applicant: SHINE-FILE LLC, Burlington, MA (US)

(72) Inventors: Jaehee Sweeney, Burlington, MA (US); ChunSeob Hwang, Seoul (KR); Michael Patrick Sweeney, Burlington, MA (US)

(73) Assignee: SHINE-FILE LLC, Burlington, MA (US)

( * ) Notice: Subject to any disclaimer, the term of this patent is extended or adjusted under 35 U.S.C. 154(b) by 36 days.

(21) Appl. No.: 14/980,259

(22) Filed: Dec. 28, 2015

(65) Prior Publication Data

US 2017/0182632 A1 Jun. 29, 2017

(51) Int. Cl.

| | |
|---|---|
| ***B24B 3/06*** | (2006.01) |
| ***B24D 7/18*** | (2006.01) |
| ***B24D 7/14*** | (2006.01) |

(52) U.S. Cl.

CPC ..... *B24D 7/18* (2013.01); *B24D 7/14* (2013.01)

(58) Field of Classification Search

CPC ..... B24D 3/04; B24D 3/06; B24D 15/02
USPC ..... 451/527, 529, 530, 526, 523–525, 57
See application file for complete search history.

(56) References Cited

U.S. PATENT DOCUMENTS

| | | | | |
|---|---|---|---|---|
| 4,114,322 | A | 9/1978 | Greenspan | |
| 4,456,500 | A | 6/1984 | Ibata | |
| 4,839,005 | A | 6/1989 | Katsumoto et al. | |
| 5,725,420 | A | 3/1998 | Torii | |
| 5,782,682 | A * | 7/1998 | Han | B24B 7/22 451/527 |
| 6,419,574 | B1 * | 7/2002 | Takahashi | B24B 53/017 451/443 |
| 6,439,986 | B1 * | 8/2002 | Myoung | B24B 53/017 451/443 |
| 6,729,950 | B2 | 5/2004 | Park et al. | |
| 7,070,480 | B2 * | 7/2006 | Moon | B24B 37/26 451/36 |
| 7,662,028 | B2 | 2/2010 | Feng et al. | |
| 2014/0273777 | A1 * | 9/2014 | Lefevre | B24B 37/26 451/529 |

* cited by examiner

*Primary Examiner* — Robert Rose
(74) *Attorney, Agent, or Firm* — McCoy Russell LLP

(57) ABSTRACT

Methods and systems are provided for design and manufacture of a non-metallic polishing tool capable of polishing different surfaces and achieving a smooth and shiny finish. The polishing tool comprises an abrasive coated base surface, and a plurality of engravings in the base surface, forming cylindrical pillars. The pillars are arranged in concentric circular patterns to provide uniform polish and shine on a target material.

13 Claims, 2 Drawing Sheets

AND MANUFACTURE OF AN ABRASIVE POLISHING TOOL

FIELD

The present description relates generally to design and manufacture of a polishing tool for polishing different surfaces to achieve a smooth and shiny finish.

BACKGROUND/SUMMARY

Uneven surfaces of metals (e.g. aluminum, brass, copper, steel etc.), non-metallic materials (e.g. wood, synthetic resin) and biological tissues (e.g. nail, bone) may require polishing in order to achieve a smooth and shiny finish. Traditional polishing methods involve separate grinding and buffering steps in order to achieve a high level of polish and shine on a material surface.

Filing tools such as metallic files and sandpaper are commonly used for grinding and polishing a plurality of material surfaces. Also, non-woven cloth or woven cloth impregnated with abrasive grain and resin may be used for polishing however such techniques require repeated work with application of different type and size of abrasives and grits to achieve desired smoothness, shines and gloss on the targeted surface. In addition there is a danger of friction burn when certain abrasive materials and grit sizes are used on biological tissues such as human nails. In one example, Ibata et al. in U.S. Pat. No. 4,456,550 have designed and manufactured an all-metallic polishing tool with cutting teeth having acute cutting angles. The cutting teeth used for polishing functions are organized in a square pattern on the abrasive surface.

However, the inventors herein have recognized potential issues with such systems. As one example, with the square or rectangular arrangement of cutting teeth as shown by Ibata et al., it is difficult to achieve a uniform smoothness and shine on a surface. Also metallic polishing tools are prone to oxidation and/or corrosion which may result in safety and hygiene related concerns when used on biological tissues. In addition use of such metallic tools may result in scratches on the surface of soft target materials.

In one example, the issues described above may be addressed by a polishing tool comprising a base surface, and a plurality of engravings in the base surface, wherein, the engravings form cylindrical pillars, the pillars arranged in concentric circular patterns.

In further examples, a non-metallic polishing tool comprises an abrasive material with a flat planer surface possessing perpendicular or acute angles between a polishing surface of the abrasive material and a uniformly engraved pattern artificially created on the abrasive coated base material. The engraved pattern may be arranged in a circular manner on the surface of the polishing tool, as well as with a specified spacing so that pillars are positioned at various angles across the surface. By using such a tool, grinding and buffering may be combined in one step in order to achieve a smooth and shiny polished surface on a target material.

As one example, a polishing tool may be manufactured from non-metallic materials such as ceramic and/or safety glass which have a high level of hardness. An abrasive coating may be deposited on a flat base material. In an alternative embodiment, the polishing tool may be partly or completely manufactured using one or more metallic components. The polishing tool may comprise cylindrical pillars (e.g., teeth) formed due to repeated engraved patterns on the flat surface of the abrasive coated base material. The abrasive coated base material used may poses a higher level of hardness compared to the target material being polished. The side-wall of the uniformly created engraved pattern may form a right or an acute angle to the flat grinding surface of the abrasive coated base material. The cylindrical shaped teeth may be arranged in circular patterns on the abrasive coated base material.

The single polishing tool may provide both grinding and buffering functionalities thereby providing a smooth and shiny finish on the target surface. The flat polishing surface may be utilized for the grinding function and the edges of the uniformly engraved patters may provide a high level of gloss on the polishing surface. In this way by using a single polishing tool both grinding and shining operations may be carried out simultaneously thereby improving the efficiency of the process. By arranging the teeth in a circular pattern it is possible to use the tool in any direction providing uniform grinding throughout the polishing area of the target material. Also, due to the circular arrangement and the uniformity in polishing, easily scratched non-metallic target material may remain scratch-free during the polishing process. In one example, due to the uniformity of the polishing process, the high level of polish achieved by using this tool on a toe nail may last more than a month and the polish on a finger nail may last between two to three weeks.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1A:
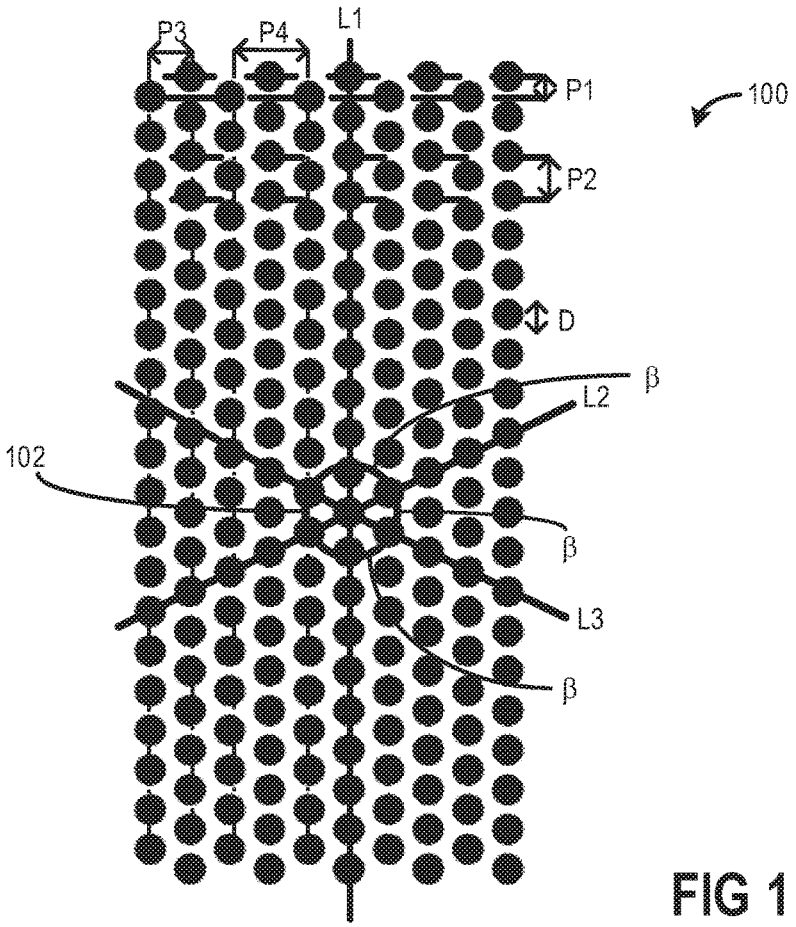
FIG. 1A shows a top view of an example circular arrangement of a repeated engraved pattern on a base abrasive surface.
Figure 1B:
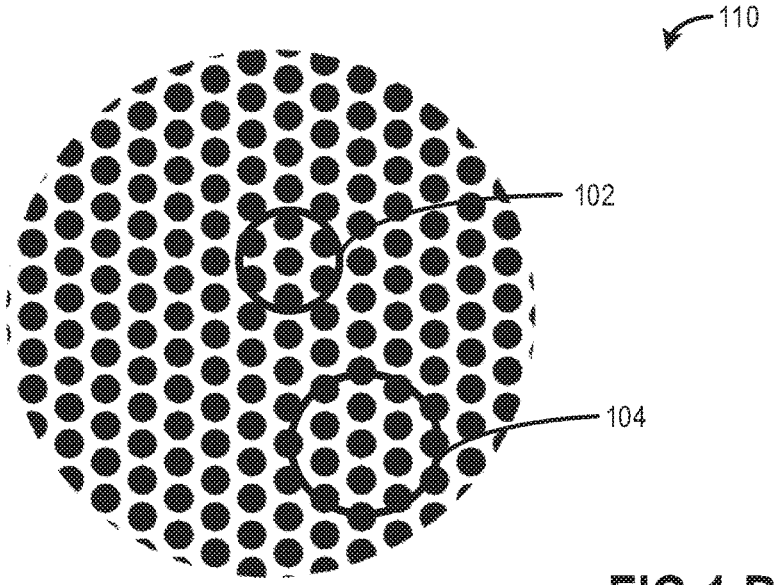
FIG. 1B shows a top view of another example circular arrangement of the repeated engraved pattern on a base abrasive surface.
Figure 2:
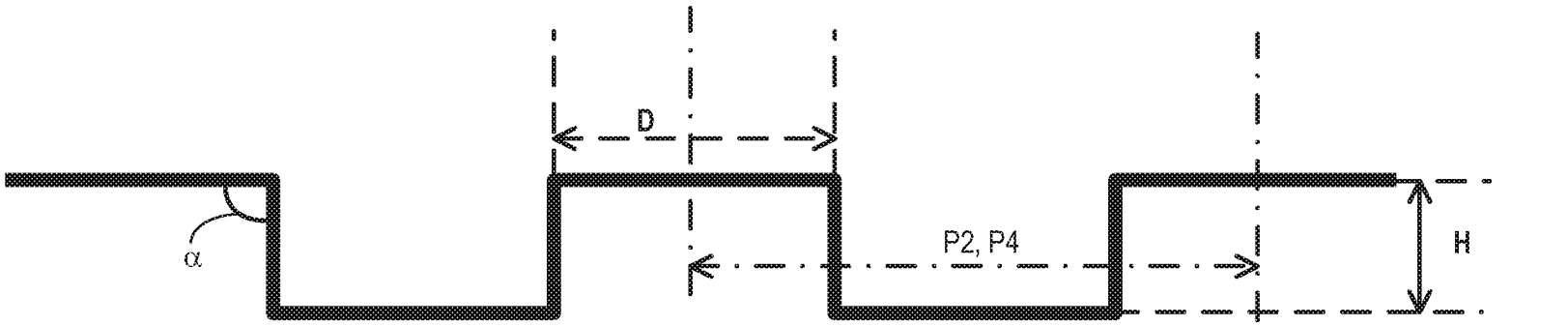
FIG. 2 shows a cross-sectional view of the polishing tool.

A polishing tool capable of effectively grinding and polishing a plurality of surfaces is shown in FIGS. 1A-B and 2. FIGS. 1A and B show top views of example circular arrangements of the repeated cylindrical pillars (teeth) caused by the engraved pattern on the base abrasive material. The engravings form cylindrical pillars and are arranged in concentric circular patterns. The black dots show the flat abrasive coated base material surface on the top surface of the cylindrical pillars whereas the intermediate white areas represent the engraved part of the surface. FIG. 1A shows a rectangular shaped polishing tool 100 and FIG. 1B shows a circular polishing tool 110. Polishing tools as described in this disclosure may be manufactured in any shape and size.

In FIG. 1A seven cylindrical pillars are arranged in a circular pattern forming one unit 102 in a rectangular shaped polishing tool 100. The seven pillar unit comprises six pillars arranged in a circular pattern with a seventh pillar in the center of the circular pattern. Lines L1, L2 and L3 pass through three sets of diagonally opposite pillars in the unit 102. Each of the lines L1, L2 and L3 pass through the central pillar. Moving in a clockwise direction, the angle circumscribed by lines L1 and L2 is denoted by angle β. Due to the uniformity of the pattern the angles circumscribed by lines L2 and L3 and L3 and L1 respectively are also β. Therefore the angles circumscribed by two lines (planes) passing through any two adjacent pillars and the central pillar in the unit 102 forms an angle β. The value of the angle β is 60°.

As shown in FIG. 1A, the distance between two consecutive horizontal rows of pillars is denoted by P1 whereas the distance between the centers of two individual consecutive pillars in the horizontal direction is denoted as P2. Similarly, the distance between two consecutive vertical rows of pillars is denoted by P3 whereas the distance between the centers of two individual consecutive pillars in the vertical direction is denoted as P4. The distances between the centers of two individual consecutive pillars in each of the horizontal and vertical directions (P2 and P4) may be equal and may be termed as the pitch of the pattern. Also, the distances between two consecutive rows of pillars in each of the horizontal and vertical directions (P1 and P3) may be equal and may be termed as the span of the pattern. The diameter of each of the pillars is denoted by D. The pitch, span and diameter remain constant throughout the abrasive tool. In one example, the values of pitch (P2 and P4) and span (P1 and P3) may vary from 100 nm to several hundred micrometers and the value of diameter (D) may be of the order of 200 nm. In another example, the values of pitch (P2 and P4), span (P1 and P3) and diameter (D) may vary from 10 μm to 2500 μm. Polishing tools with different values of pitch, span and diameter may be manufactured to better suit a specific group of target materials. The black dots (flat abrasive coated top surface of the cylindrical pillars) may cover 40 to 70% of the total area of the polishing tool.

The repeating pattern comprising pillars and engravings on a non-metallic surface may be achieved by a precisely controlled manufacturing technique such as microlithography, nanolithography and high precision coating, followed by multiple chemical etching processes. In this way it is possible to accurately fabricate polishing tool with feature sizes in the nanometer and micron range.

In FIG. 1B the top view of a circular polishing tool 110 is shown. Within the polishing tool 110, circular arrangements comprising exactly seven and nineteen pillars (denoted by 102 and 104 respectively) are present. Such circular arrangements provide uniformity during grinding and polishing functions. Due to the circular arrangement of the units, the target material is not required to be aligned in any specific direction during the polishing operation. In other words, the target surface may be aligned in any direction to achieve a high level of finish. The polishing tool may be of any shape or size depending on the application (size of the target surface). The base material may be manufactured from safety glass and/or ceramic based materials. Unlike metals such materials do not require surface after-treatments with chemicals for corrosion resistance. Also they provide a cost effective option compared to other potential materials (e.g. ruthenium, rhodium, palladium, silver, osmium, iridium, platinum, gold etc.) with high natural corrosion and oxidation resistance.

FIG. 2 shows a cross-sectional view 200 of the polishing tool 100 comprising engravings on an abrasive coated base material. Due to the engravings, uniformly spaced pillars are formed with the abrasive material on the top surface. The angle between the top surface and a side face of a pillar is a right or an acute angle α. The value of α may be ≤90°. In one example, by manufacturing polishing tools with the value of the angle α between 85° and 90°(90°≥α≥85°) the lifetime of the pillars may be prolonged. Also with 90°≥α≥85°, enhanced grinding and buffering capabilities may be achieved. The diameter of the top surface of each cylindrical pillar is denoted by D (as also shown in FIG. 1A). The diameter of the top surface of every one of the cylindrical pillar (e.g. teeth) is constant and planar with one another throughout the entire polishing tool. The depth of the engraving from the top abrasive coated base to the engraved lower surface is denoted by H. The distance between the centers of two individual consecutive pillars in the horizontal and/or vertical direction is denoted by pitch (also shown in FIG. 1A as P2/P4).

When the polishing tool is applied to a rough target surface, the angular part (edge) of the flat polishing surface may effectively grind the target surface while the non-engraved top abrasive part (the abrasive coated base material) may simultaneously provide high gloss polishing. The grinding and buffering operations include moving the tool in directions including forward/backward, left/right, angles therebetween, and circular rotation. In alternative embodiments any pattern of teeth any be formed and types of such patterns should not be limited to those mentioned herein.

FIGS. 1A-B and 2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

It will be appreciated that the configurations disclosed herein are exemplary in nature, and that these specific embodiments are not to be considered in a limiting sense, because numerous variations are possible. For example, while a flat planar base surface is described in the example, a curved base planar surface may be used, if desired. The subject matter of the present disclosure includes all novel and non-obvious combinations and sub-combinations of the various systems and configurations, and other features, functions, and/or properties disclosed herein.

In one example, a polishing tool comprises a base surface, and a plurality of engravings in the base surface, wherein, the engravings form cylindrical pillars, the pillars arranged in concentric circular patterns. In the preceding example, additionally or optionally, the base surface is coated with an abrasive layer. In any or all of the preceding examples, additionally or optionally, the engravings are uniformly distributed on the base surface. In any or all of the preceding examples, additionally or optionally, the engraving is repeated in a horizontal and vertical direction at a constant pitch. In any or all of the preceding examples, additionally or optionally, a dimension of the pitch is higher than 100 nm. In any or all of the preceding examples, the concentric circular pattern, additionally or optionally, form repeating unit cells. In any or all of the preceding examples, additionally or optionally, the unit cells comprise one of exactly seven and exactly nineteen cylindrical pillars. In any or all of the preceding examples, the polishing tool additionally or optionally consists essentially of a non-metallic material, the non-metallic material being one of safety glass and ceramic.

In another example, a polishing tool comprises a repeated unit of cylindrical teeth, wherein, a top surface of each of the teeth is flat, the polishing tool comprising a non-metallic material. In the preceding example, additionally or optionally, each of the cylindrical teeth includes a side wall making an angle with the top surface, wherein the angle is an acute angle, and wherein a distance between two consecutive teeth is equal throughout the polishing tool. In any or all of the preceding examples, additionally or optionally, a diameter of the top surface of every one of the teeth is constant and planar with one another throughout the entire polishing tool. In any or all of the preceding examples, additionally or optionally, the top surface includes an abrasive layer for polishing.

In yet another example a method for operating a polishing tool comprises applying the same polishing tool for both grinding and buffering operations to a component, thereby providing a smooth and shiny finish on a target surface of the product, wherein a flat planar polishing surface of the tool is utilized for the grinding operation and edges of a uniformly engraved pattern on the polishing surface provides a desired level of gloss on the component's surface, the polishing surface comprising circularly positioned cylinders, each of the grinding and buffering operations moving the tool in directions including forward/backward, left/right, angles therebetween, and circular rotation. In the preceding example, additionally or optionally, the polishing tool includes a coating in its surface. In any or all of the preceding examples, additionally or optionally, the polishing tool consists essentially of non-metallic material. In any or all of the preceding examples, the polishing tool additionally or optionally consists of metallic components. In any or all of the preceding examples, the cylinders are additionally or optionally positioned with repeating patterns having a specified spacing.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A polishing tool comprising:

a base surface; and a plurality of engravings in the base surface;

wherein the engravings form a plurality of pillars, the pillars arranged in concentric circular patterns forming repeating unit cells;

wherein each of the pillars with diameters between 100 nm-500 μm in the repeating unit cells includes a top surface with an abrasive material and a side face forming an angle with the top surface, the angle is between 75-90 degrees;

wherein a pitch between consecutive pillars in the plurality of pillars remains constant in the repeating unit cells and is between 10 μm and 700 μm, the pitch defined as a distance between centers of two consecutive pillars; and wherein the pillars cover 40-70% of a total area of an abrasive layer of the polishing tool.

2. The tool of claim 1, wherein the base surface is coated with the abrasive layer.

3. The tool of claim 2, wherein the engravings are uniformly distributed on the base surface.

4. The tool of claim 3, wherein the engravings are repeated in horizontal and vertical directions at the constant pitch.

5. The tool of claim 4, wherein the repeating unit cells comprise one of exactly seven and exactly nineteen pillars.

6. The tool of claim 5, wherein the polishing tool consists essentially of a non-metallic material, the non-metallic material being one of safety glass and ceramic.

7. A polishing tool comprising:

a repeated unit of a plurality of teeth forming repeating unit cells, each of the plurality of teeth including a flat top surface with an abrasive material and a side face forming an angle with the flat top surface, the angle being between 75-90 degrees, each and every cell being one of the repeating unit cells;

wherein each of the plurality of teeth comprises a non-metallic material; and wherein a pitch between consecutive teeth in the plurality of teeth remains constant in the repeating unit cells and is between 10 μm and 700 μm, the pitch defined as a distance between centers of two consecutive teeth.

8. The tool of claim 7, wherein a diameter of the flat top surface of every one of the teeth is constant and planar with one another throughout the entire polishing tool.

9. The tool of claim 8, wherein the flat top surface includes an abrasive layer for polishing.

10. A method for operating a polishing tool, comprising:

applying the same polishing tool for both grinding and buffering operations to a component, thereby providing a smooth and shiny finish on a target surface of a product, wherein edges of a uniformly engraved pattern on a polishing surface is utilized for grinding operation and a flat planar polishing surface provides a desired level of gloss on the surface of the component, the polishing surface comprising circularly positioned pillars forming repeating unit cells, each of the grinding and buffering operations moving the polishing tool in directions including forward/backward, left/right, angles therebetween, and circular rotation;

wherein each of the circularly positioned pillars includes a top surface with an abrasive material and a side face forming an angle with the top surface, the angle being between 75-90 degrees; and wherein a pitch between consecutive pillars of the circularly positioned pillars remains constant in the repeating unit cells and is between 10 μm and 700 μm, the pitch defined as a distance between centers of two consecutive pillars.

11. The method of claim 10, wherein the polishing tool includes a coating on the top surface.

12. The method of claim 10, wherein the polishing tool consists essentially of non-metallic material.

13. The method of claim 10, wherein the polishing tool consists of metallic components.

* * * * *